United States Patent [19]

Weisman

[11] 4,333,251

[45] Jun. 8, 1982

[54] AUTOMATIC BUCKET LEVELER

[75] Inventor: Roland E. Weisman, Wilmot, Wis.

[73] Assignee: International Harvester Co., Chicago, Ill.

[21] Appl. No.: 227,849

[22] Filed: Jan. 23, 1981

[51] Int. Cl.[3] ..... D06F 81/00

[52] U.S. Cl. ..... 37/118 R; 37/DIG. 17; 414/701

[58] Field of Search ..... 37/118 R, DIG. 1, DIG. 19; 414/699-701; 200/61.45 R, 61.45 M; 91/358 R, 358 A, 361

[56] References Cited

U.S. PATENT DOCUMENTS

| | | | |
|---|---|---|---|
| 3,420,393 | 1/1969 | Omon | 414/701 |
| 3,487,968 | 1/1970 | Long | 414/701 |
| 3,713,557 | 1/1973 | Seaberg et al. | 414/700 |
| 3,782,248 | 1/1974 | Fuzzell | 414/699 X |
| 3,929,245 | 12/1975 | Inoue | 414/701 |
| 4,099,449 | 7/1978 | Orimoto | 91/358 A |

FOREIGN PATENT DOCUMENTS

| | | | |
|---|---|---|---|
| 2832885 | 2/1980 | Fed. Rep. of Germany | 37/DIG. 1 |
| 1214761 | 12/1970 | United Kingdom | 414/701 |

OTHER PUBLICATIONS

Operators on Anual Models 510 and 515 Pay Loader, International Harvester Co., Form OM-510/515-1, Jan. 1979.

*Primary Examiner*—E. H. Eickholt

*Attorney, Agent, or Firm*—Dennis K. Sullivan; F. D. Au Buchon

[57] ABSTRACT

An automatic bucket leveler is located on the underside of a bucket piston cylinder unit and is preset to stop the bucket in a horizontal or digging position. A trip bar is attached to the cylinder piston rod and moves with the cylinder piston rod through a magnetic field which is created by a proximity switch and is completed by a proximity of the trip bar within the magnetic field. A trip bar guide is provided as a part of the automatic bucket leveler structure which functions to protect the proximity switch from damage by encounter with the trip bar and keeps the trip bar in correct relationship to the proximity switch, within the magnetic field, as the trip bar passes alongside of the proximity switch.

7 Claims, 7 Drawing Figures

AUTOMATIC BUCKET LEVELER

This invention relates to tractor loader vehicles, and in particular to an automatic bucket leveler means.

In prior art tractor loader vehicles, which are equipped with automatic bucket levelers, the automatic bucket leveler is located on the underside of a bucket piston cylinder unit and is arranged to stop the bucket in a horizontal or digging position. A trip bar is attached to the piston rod and moves with the piston rod. A proximity switch, which is mounted on the cylinder tube body, creates a magnetic field circuit which is completed by the proximity of the trip bar within the magnetic field. The proximity switch cuts off an electric current to a detent magnet, which controls a bucket control valve plunger. Once the bucket is dumped, a bucket control lever is moved back to a detent bucket roll back position. When the bucket has reached its preset position, the trip bar has moved out of the magnetic field created by the proximity switch and the bucket automatically stops and the bucket control lever returns to a hold position. A disadvantage with the prior art automatic bucket leveler is that the trip bar is cantilevered on the piston rod so that any debris falling from the bucket may possibly deflect the trip bar away from the proximity switch, or the cantilevered free end of the free end of the trip bar may possibly start vibrating, or be bent, and come in contact with and damage the proximity switch.

My invention provides an automatic bucket leveler means having a trip bar guide means which is fastened to the bottom of the bucket cylinder tube and a slide weldment or trip bar mounting means which is fastened to a bottom flat surface provided on the connecting eye end of the piston rod. The trip bar guide means protects the proximity switch from damage, by encounter with the trip bar, and keeps the trip bar in correct relationship to the proximity switch as the trip bar passes alongside of the proximity switch within the magnetic field. Another advantage of my automatic bucket leveler means is that the longitudinal axis of the slide or trip bar is on a first vertical plane which coincides with a second vertical plane passing through the longitudinal axis of the hydraulic cylinder and piston unit, the unit thereby shielding the automatic bucket lever means and the cantilevered trip bar from falling debris. The prior art automatic bucket leveler usually is mounted on a third vertical plane parallel to the aforementioned second vertical plane which passes through and coincides with the longitudinal axis of the hydraulic cylinder and piston rod, thus exposing the slide or trip bar to falling debris. Also, usually the prior art trip bar is mounted to a bracket sleeved on the piston rod axially spaced from the connecting eye end, thereby necessitating adding to the length of the piston rod in order to accommodate the bracket sleeve thereon.

The various figures in the accompanying drawing illustrate a suitable arrangement for a constructive practice of my invention, wherein.

Figure 1:
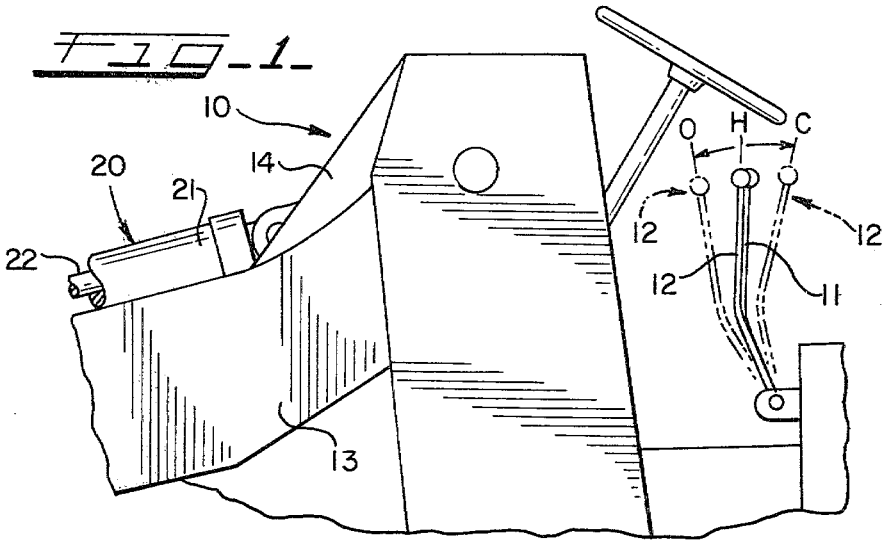
FIG. 1 is a partial left side view of a tractor loader vehicle.

With reference now to the various figures of the drawing, wherein similar numerals refer to similar parts in the several views, and with particular reference to FIG. 1, there is shown a partial left side view of a tractor loader vehicle 10 and an operator's compartment having boom and bucket control levers 11 and 12. A pair of left and right boom arms 13 are pivotally mounted to the lateral sides of a front frame 14. The cylinder tube 21 of the bucket hydraulic cylinder and piston unit 20 is pivotally mounted, centrally on the front frame 14. As shown in dash-dot lines, the bucket control lever 12 is pivotable fore-and-aft, between a forward open bucket position "O", a central neutral hold position "H" and a rearward close or bucket roll-back position "C".

Figure 2:
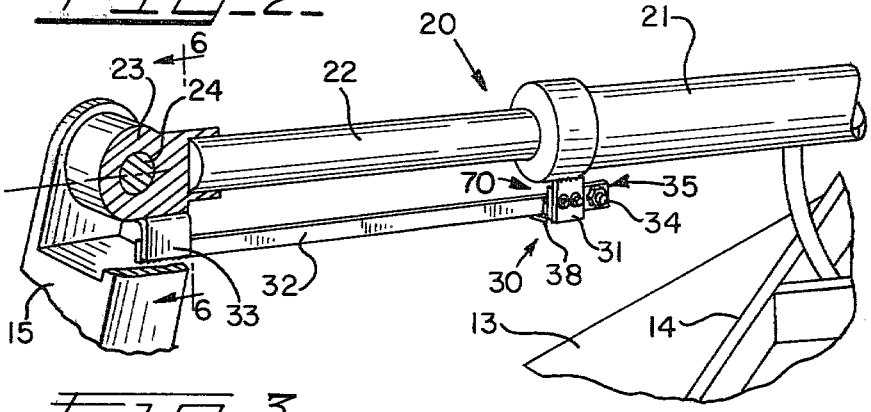
FIG. 2 is a partial isometric left side view of a bucket hydraulic piston cylinder unit incorporating the automatic bucket leveler means of my invention.

With reference now to FIG. 2, the piston rod 22, of the hydraulic piston cylinder unit 20, has an eye end means 23 mounted by a pivot pin 24 to a bucket rock arm 15. The improved automatic bucket leveler means 30 is mounted underneath the piston cylinder unit 20. A support beam or bar 31 is fixed or welded to the underside of the cylinder tube 21 and carries the proximity switch 34 and the trip bar guide means 70. The connecting eye end means 23 carries the slide weldment 33 to which is fixed or welded the trip bar 32.

Figure 6:
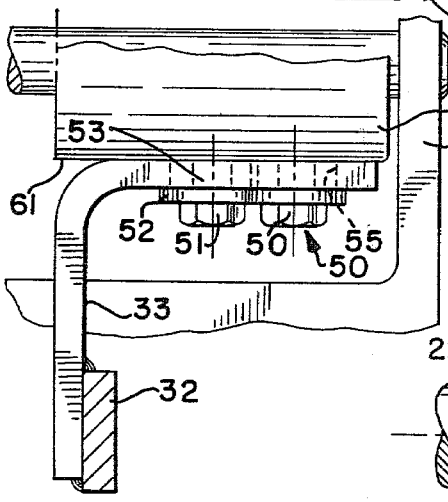
FIG. 6 is a view of the slide weldment or trip bar mounting means as taken in the direction of arrows 6—6 in FIG. 2.
Figure 7:
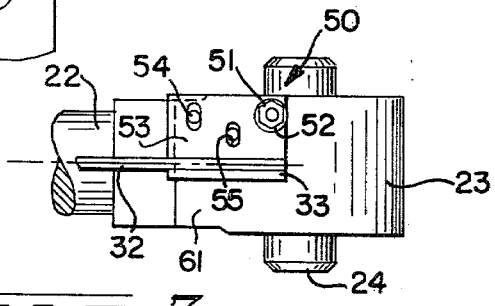
FIG. 7 is another view of the slide weldment or trip bar mounting means as taken in the direction of arrows 7—7 in FIG. 3.

Referring now to FIGS. 6 and 7, the slide weldment or trip bar support arm means 33 is mounted to a flat surface 61 on the underside of the piston rod eye means 23 by any suitable fastening means 50, such as three or more hex head bolts 51 and washers 52, which pass through a similar number of alignment slots 55 in a cross arm 53 of the trip bar support bracket means 33 and thread into tapped holes 54 provided in the flat 61 of the piston rod eye means 23.

Figure 3:
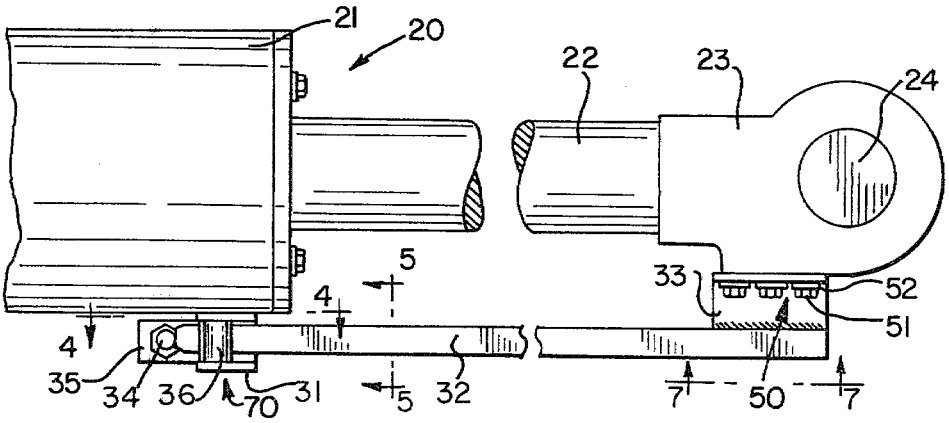
FIG. 3 is a partial right side view of the hydraulic piston cylinder unit and the automatic bucket leveler means shown in FIG. 2.
Figure 4:
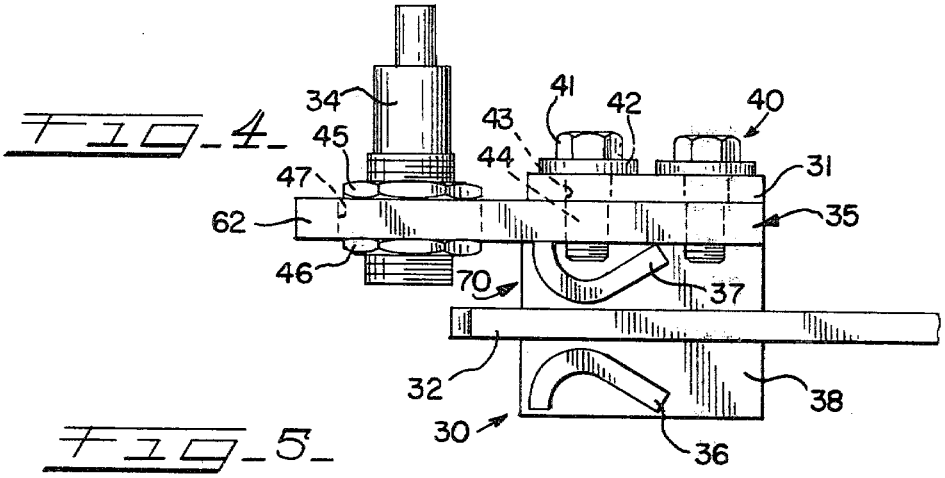
FIG. 4 is a view of the slide or trip bar guide means and proximity switch as taken in the direction of arrows 4—4 of FIG. 3.
Figure 5:
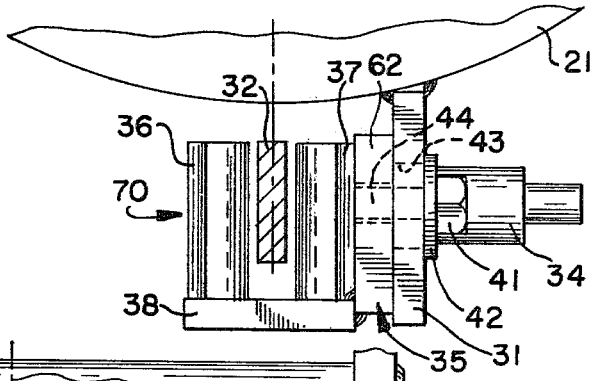
FIG. 5 is another view of the slide or trip bar guide means and proximity switch as taken in the direction of arrows 5—5 in FIG. 3.

Referring now to FIGS. 3, 4 and 5, the proximity switch 34 and the trip bar guide means 70 are carried on an angled bracket means 35 which is fastened to the cylinder hanger bar 31 by any suitable fastening means 40, such as two or more hex head bolts 41 and washers 42, which pass through a similar number of alignment slots 43 provided in the hanger bar 31 and thread into threaded holes 44 provided in the longer arm 62 of the angled support bracket means 35. The proximity switch 34 is mounted to the projecting end of arm 62 and is held in place by jam nuts 45 and 46 on opposite sides of the long arm 62 of the angled support bracket means 65. A slotted opening or alignment slot 47 is provided in the long arm 62 for adjusting the position of the proximity switch 34 and the magnetic field as a step for preseting the position of the bucket and non-proximity point for the free end of the trip bar 32. The free or cantilevered end of the trip bar or slide 32 passes between semi-U-shaped guide finger means 36 and 37 which are mounted to a cross arm or base plate 38 that is shorter than the arm 62. The guide finger means 36 and 37 are arranged with the curved portions of the semi-U's facing the trip bar 32 in such a manner that the straight arms of the semi-U's guide the trip bar between the curved portions when sliding in a longitudinal direction into the proximity of the proximity switch 34 and maintain the trip bar in correct relationship to the proximity switch 34 and magnetic field when passing alongside the proximity switch 34.

As shown in FIGS. 2, 5 and 6, the longitudinal axis of the trip 32 lies on a vertical plane passing through and coincident with the longitudinal axis of the hydraulic piston cylinder unit 20. The piston rod 22 and the cylinder tube 21 shield the trip bar 32 from any falling debris, and guide finger means 36 and 37 protect the proximity switch 34 by limiting lateral deflection, bending or vibration of the trip bar 32 towards and away from the proximity switch 34, and the base plate 38 of the angle bracket means 35 shields the cantilevered free end of the trip bar 32 from upwardly impacts after it passes out of the magnetic field at the non-proximity point through the straight arms of the semi-U shaped guide finger means 36 and 37.

As the trip bar moves in a forwardly direction with the extending piston rod 22, the proximity switch 34 closes an electric circuit which creates a magnetic field that is completed by the proximity of the trip bar 32 laterally adjacent to the proximity switch 34. Once the bucket (not shown) is closed, the bucket control lever 12 is moved from the open "O" position rearwardly to the roll back or close "C" position. When the bucket reaches the preset horizontal close "C" position, the trip bar 32 has moved out of the magnetic field created by the proximity switch 34 opening the electric circuit. The bucket automatically stops and the bucket control lever 12 returns to the central neutral or hold position "H".

What is claimed is:

1. An automatic bucket leveler means for a tractor loader vehicle having a frame, a bucket pivotally mounted to a pair of boom arms pivotally mounted to the frame, a rocking lever pivotally mounted to and between the boom arms and having one end pivotally connected to the bucket and an opposite end pivotally connected to a connecting eye end means of a hydraulic piston rod, the hydraulic piston rod telescopically slidable from an open end of a cylinder tube, the cylinder tube having a closed end pivotally mounted to the frame centrally between the boom arms on a longitudinally extending axis, a first bracket means connected to the cylinder tube and a second bracket means connected to the connecting eye end means of the piston rod for mounting the automatic bucket leveler means thereto on a plane vertically passing through the longitudinal axis, a trip bar connected at one end to the second bracket means and having a free end longitudinally extending toward the first bracket means on the vertical plane, a proximity switch connected to the first bracket means and laterally spaced from the trip bar, and a trip bar guide means mounted to the first bracket means and having guide finger means longitudinally spaced from the proximity switch and laterally spaced apart on opposite sides of the vertical plane and trip bar, the guide finger means maintaining the trip bar in proper laterally spaced apart relationship to the proximity switch.

2. The invention according to claim 1 wherein the guide finger means are mounted to a base plate forming a bottom shield under the free end of the trip bar after sliding past the proximity of the proximity switch.

3. The invention according to claim 2 wherein the base plate is connected at right angles to a second plate longitudinally longer than the base plate, the longer second plate supporting the proximity switch on one longitudinal end and connected on an opposite second end to the first bracket means, the second end having first means for vertically shifting and positioning the guide finger means and providing clearance for the trip bar, and the one end having second means for longitudinally shifting and positioning the proximity switch for preseting a non-proximate point for the free end of the trip bar, and wherein the second bracket means has third means for laterally shifting and positioning the trip bar on the vertical plane.

4. The invention according to claim 2 or claim 3 wherein the guide finger means are semi-U-shaped and are mounted to the base plate with the curved portion of the semi-U's facing the trip bar and the straight portion flaring outwardly in a guiding manner to guide the free end of the trip bar between the curved portion when sliding in a longitudinal direction into the proximity of the proximity switch.

5. The invention according to claim 4 wherein the connecting eye end means of the piston rod is provided with a flat surface and the second bracket means is provided with a cross arm mounted to the flat surface.

6. The invention according to claim 5 wherein the third shifting and positioning means are at least three triangularly arranged spaced apart slots provided through the cross arm and extending perpendicular to the vertical plane and trip bar maintaining the trip bar parallel to the longitudinal axis.

7. The invention according to claim 5 wherein the first shifting and positioning means are at least two vertically extending longitudinally spaced part slots, and the second shifting and positioning means is at least one longitudinally extending slot.

* * * * *